US010012419B2

(12) United States Patent
Jeong et al.

(10) Patent No.: US 10,012,419 B2
(45) Date of Patent: Jul. 3, 2018

(54) HEAT-PUMP SYSTEM

(71) Applicant: LG Electronics Inc., Seoul (KR)

(72) Inventors: Hojong Jeong, Seoul (KR); Song Choi, Seoul (KR); Minhwan Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 523 days.

(21) Appl. No.: 14/612,825

(22) Filed: Feb. 3, 2015

(65) Prior Publication Data

US 2015/0219372 A1 Aug. 6, 2015

(30) Foreign Application Priority Data

Feb. 5, 2014 (KR) ..... 10-2014-0013254

(51) Int. Cl.

| | |
|---|---|
| ***F25B 43/02*** | (2006.01) |
| ***F25B 31/02*** | (2006.01) |
| ***F25B 30/02*** | (2006.01) |
| ***F25B 31/00*** | (2006.01) |
| ***F25B 6/04*** | (2006.01) |
| ***F25B 6/00*** | (2006.01) |
| ***F25B 6/02*** | (2006.01) |
| ***F25B 13/00*** | (2006.01) |

(Continued)

(52) U.S. Cl.

CPC ..... *F25B 31/02* (2013.01); *F25B 6/00* (2013.01); *F25B 6/02* (2013.01); *F25B 6/04* (2013.01); *F25B 13/00* (2013.01); *F25B 27/00* (2013.01); *F25B 30/02* (2013.01); *F25B 31/002* (2013.01); *F25B 31/004* (2013.01); *F25B 49/02* (2013.01); *F25B 2313/004* (2013.01); *F25B 2313/0253* (2013.01); *F25B 2313/0254* (2013.01); *F25B 2327/001* (2013.01); *F25B 2400/0751* (2013.01); *F25B 2600/2519* (2013.01)

(58) Field of Classification Search

CPC ..... F25B 31/004; F25B 31/002; F25B 6/00; F25B 6/02; F25B 2313/0253; F25B 2313/0254; F25B 2400/0751

See application file for complete search history.

(56) References Cited

U.S. PATENT DOCUMENTS 3,013,403 A * 12/1961 Grant ..... F25B 7/00 62/175

4,586,351 A 5/1986 Igarashi et al.

(Continued)

FOREIGN PATENT DOCUMENTS

EP 0563570 A1 10/1993
EP 1605212 A2 12/2005

(Continued)

*Primary Examiner* — Orlando E Aviles Bosques

(74) *Attorney, Agent, or Firm* — Birch, Stewart, Kolasch & Birch, LLP

(57) ABSTRACT

Provided is a heat-pump system including a plurality of compressors, wherein the plurality of compressors includes a first compressor and a second compressor that compress refrigerant, an oil separator provided on a discharge side of the plurality of compressors to separate oil mixed with refrigerant compressed by the plurality of compressors, an oil separation pipe extended from the oil separator to allow the plurality of compressors to recover oil, and a compressor side oil balance pipe extended from the second compressor to allow the first compressor to recover oil stored in the second compressor.

10 Claims, 5 Drawing Sheets

(51) Int. Cl.
*F25B 49/02* (2006.01)
*F25B 27/00* (2006.01)

(56) References Cited

U.S. PATENT DOCUMENTS

| | | | | |
|---|---|---|---|---|
| 4,947,657 | A * | 8/1990 | Kalmbach | F25B 6/04 62/236 |
| 6,941,767 | B2 * | 9/2005 | Matsuoka | F25B 31/004 62/470 |
| 2004/0231357 | A1 | 11/2004 | Matsuoka et al. | |
| 2008/0085195 | A1 | 4/2008 | Shaw | |
| 2008/0087027 | A1 | 4/2008 | Park et al. | |
| 2008/0087028 | A1 * | 4/2008 | Kim | F25B 31/004 62/84 |
| 2010/0147018 | A1 * | 6/2010 | Tomioka | F25B 31/004 62/470 |
| 2011/0162746 | A1 | 7/2011 | Zhai et al. | |
| 2011/0174005 | A1 * | 7/2011 | Takegami | F25B 1/10 62/228.1 |
| 2012/0304685 | A1 * | 12/2012 | Kiguchi | F24F 1/26 62/468 |

FOREIGN PATENT DOCUMENTS

| | | | |
|---|---|---|---|
| JP | 10-238881 | A | 9/1998 |
| KR | 20-0138990 | Y1 | 5/1999 |

* cited by examiner

HEAT-PUMP SYSTEM

CROSS-REFERENCE TO RELATED APPLICATIONS

The present application claims priority under 35 U.S.C. 119 to Korean Patent Application No. 10-2014-0013254, filed on Feb. 5, 2014, which is hereby incorporated by reference in its entirety.

BACKGROUND

The present disclosure relates to a heat-pump system.

A heat-pump system is a system that includes a heat pump cycle capable of performing a cooling or heating operation. The heat pump system may be linked to a hot water supply device or a cooling/heating device. That is, it is possible to produce hot water by using a heat source obtained through a heat exchange between refrigerant for the heat pump cycle and a certain heat storage medium or perform air conditioning for cooling and heating.

The heat pump cycle includes a compressor for compressing refrigerant, a condenser for condensing refrigerant compressed by the compressor, an expansion device for decompressing refrigerant condensed by the condenser and an evaporator for evaporating decompressed refrigerant.

The heat-pump system may be an electrical heat-pump system or a gas heat-pump system.

A compressor having a relatively small or intermediate capacity operates in the electrical heat-pump system and the compressor may operate with an electric motor.

On the contrary, the gas heat-pump system needs a compressor having a large capacity for an industrial facility or for conditioning air in a large building, rather than for a typical home. That is, in order to operate a compressor for compressing a lot of refrigerant to a gas having a high temperature and a high pressure, the gas heat-pump system may be used as a system that uses a gas engine instead of the electric motor.

The gas heat-pump system includes an engine that uses a mixture (hereinafter, referred to as "mixed fuel") of fuel and air to generate power. As an example, the engine may include a cylinder to which the mixed fuel is supplied and a piston that is provided to be capable of moving in the cylinder.

According to such a typical heat-pump system, since oil is not easily separated from refrigerant circulating during the heat pump cycle, there is a limitation in that the compressor lacks oil.

SUMMARY

Embodiments provide a heat-pump system that may properly maintain oil balance.

In one embodiment, a heat-pump system includes: a plurality of compressors, wherein the plurality of compressors includes a compressor and another compressor that compress refrigerant; an oil separator provided on a discharge side of the plurality of compressors to separate oil mixed with refrigerant compressed by the plurality of compressors; an oil separation pipe extended from the oil separator to allow the plurality of compressors to recover oil; and a compressor side oil balance pipe extended from the compressor to allow the other compressor to recover oil stored in the compressor.

The compressor may be an electromotive compressor and the other compressor may be a gas engine compressor.

The heat-pump system may further include an oil separation pipe provided on an other side of the oil separator, oil separated from the oil separator being discharged through the oil separator; and an oil separator discharge pipe provided on one side of the oil separator, refrigerant obtained by separating oil by the oil separator being discharged through the oil separator discharge pipe.

The oil separation pipe may be connected to a common suction pipe of the plurality of compressors.

The oil separation pipe may include a join portion to which the compressor side oil balance pipe is connected.

A valve device for regulating a flow of oil in the compressor side oil balance pipe may be installed at the compressor side oil balance pipe.

The heat-pump system may further include a gas-liquid separator provided at an entrance side of the plurality of compressors, wherein the gas-liquid separator separates gaseous refrigerant from refrigerant and supplies the gaseous refrigerant to the plurality of compressors; and a gas-liquid separation oil balance pipe extended from the gas-liquid separator to the common suction pipe.

The compressor may include a casing having an oil balance hole and one end of the compressor side oil balance pipe may be coupled to the oil balance hole.

The heat-pump system may further include a first outdoor unit including the compressor; and a second outdoor unit including the other compressor.

The first outdoor unit may include a first common suction pipe that guides suction of refrigerant to the compressor and recovers oil from the second outdoor unit.

The second outdoor unit may include a second common suction pipe that guides suction of refrigerant to the other compressor and recovers oil from the first outdoor unit.

The second outdoor unit may include a second oil separator into which refrigerant discharged from the other compressor flows; and an oil separator oil balance pipe extended from the second oil separator and coupled to the first common suction pipe.

In another embodiment, a heat-pump system include a first outdoor unit including an electromotive compressor and a first oil separator; a second outdoor unit including a gas engine compressor and a second oil separator; a compressor side oil balance pipe coupled to the electromotive compressor and coupled to the second outdoor unit, the compressor side oil balance pipe allowing oil in the electromotive compressor to be recovered by the gas engine compressor; and an oil separator side oil balance pipe coupled to the second oil separator and coupled to the first outdoor unit, the oil separator side oil balance pipe allowing oil in the second oil separator to be recovered by the electromotive compressor.

The heat-pump system may further include a first common suction pipe guiding suction of refrigerant to the electromotive compressor, wherein the oil separator side oil balance pipe is coupled to the first common suction pipe.

The heat-pump system may further include a second common suction pipe guiding suction of refrigerant to the gas engine compressor, wherein the compressor side oil balance pipe is coupled to the second common suction pipe.

The details of one or more embodiments are set forth in the accompanying drawings and the description below. Other features will be apparent from the description and drawings, and from the claims.

DETAILED DESCRIPTION OF THE EMBODIMENTS

Figure 1:
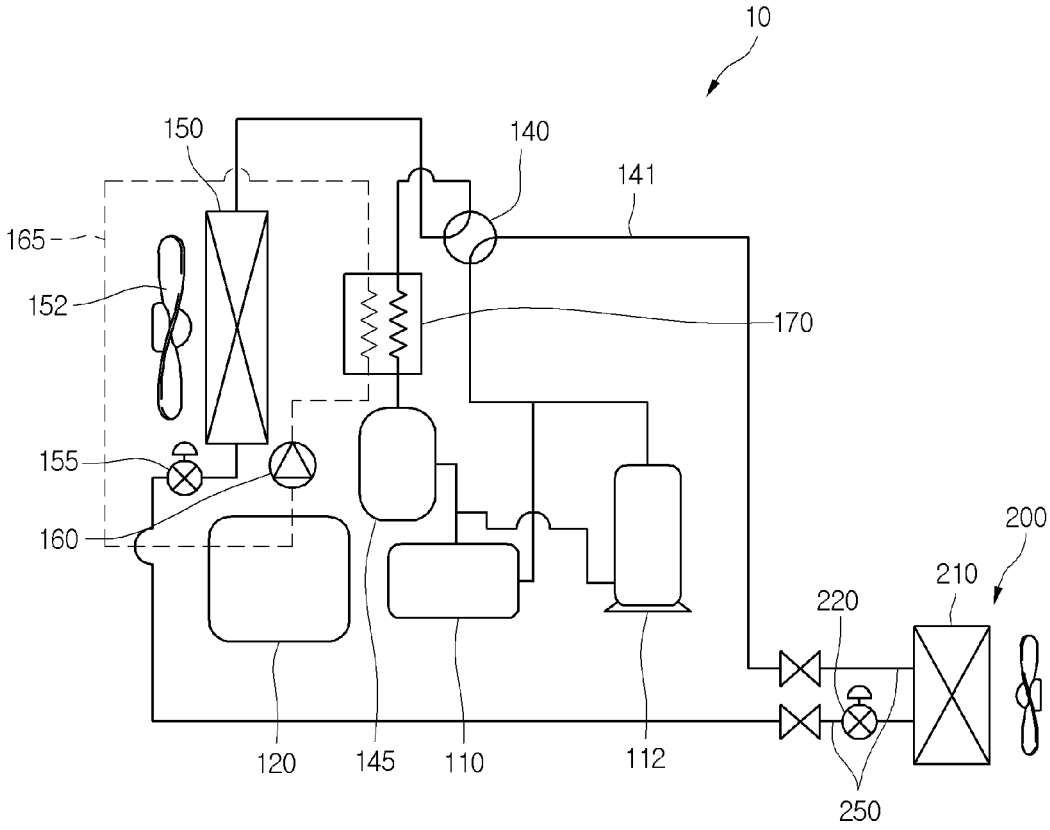
FIG. 1 is a cycle diagram showing a configuration of a heat-pump system according to a first embodiment of the present invention.

FIG. 1 is a cycle diagram showing a configuration of a heat-pump system according to a first embodiment of the present invention.

Referring to FIG. 1, a heat-pump system 10 according to an embodiment of the present invention includes a plurality of parts that configure a refrigerant cycle as an air conditioning system. More particularly, the refrigerant cycle includes first and second compressors 110 and 112 compressing refrigerant and a flow switch valve 140 switching the direction of refrigerant compressed by the first and second compressors.

The gas heat pump system 10 further includes an outdoor heat exchanger 150 and an indoor heat exchanger 210. The outdoor heat exchanger 150 may be arranged inside an outdoor unit arranged outdoors and the indoor heat exchanger 210 may be arranged inside an indoor unit 200 arranged indoors. Refrigerant passing through the flow switch valve 140 flows into the outdoor heat exchanger 150 or the indoor heat exchanger 210.

Components of the system in FIG. 1 excluding the indoor heat exchanger 210 and an indoor expansion device 220 may be arranged outdoors or inside the outdoor unit. The outdoor unit and the indoor unit 200 may be connected by a connection pipe 250.

More particularly, when the system 10 operates in a cooling operation mode, refrigerant passing through the flow switch valve 140 is condensed at the outdoor heat exchanger 150 and then flows toward the indoor heat exchanger 210. On the contrary, when the system 10 operates in a heating operation mode, refrigerant passing through the flow switch valve 140 is condensed at the indoor heat exchanger 210 and then flows toward the outdoor heat exchanger 150.

On one side of the outdoor heat exchanger 150, an outdoor expansion device 155 for decompressing refrigerant is arranged. The outdoor expansion device 155 includes an electronic expansion valve (EEV). When the system 10 operates in the heating operation mode, refrigerant passing through the indoor heat exchanger 210 decompresses at the outdoor expansion device 155 and then may be evaporated from the outdoor heat exchanger 150.

The system 10 further includes a refrigerant pipe 141 that connects the compressors 110 and 112, the outdoor heat exchanger 150 and the indoor unit 200 to guide the flow of refrigerant.

A configuration of the system 10 is described based on a cooling operation mode.

Refrigerant compressed by the first and second compressors 110 and 112 may flow into the outdoor heat exchanger 150 to heat-exchange with external air (condense). An outdoor fan 152 moving external air is provided on one side of the outdoor heat exchanger 150.

Refrigerant passing through the outdoor heat exchanger 150 flows toward the indoor unit 200, decompresses at the indoor expansion device 220 and then is evaporated from the indoor heat exchanger 210. The indoor expansion device 220 may be installed inside the indoor unit 200 and include the EEV.

Refrigerant evaporated from the indoor heat exchanger 210 flows into a secondary heat exchanger 170 via the flow switch valve 140. The secondary heat exchanger 170 is a heat exchanger that may perform heat exchange between evaporated refrigerant having a low pressure and cooling water having a high temperature and include a plate-type heat exchanger.

Since refrigerant evaporated from the indoor heat exchanger 210 may absorb heat while passing through the secondary heat exchanger 170, evaporation efficiency may be improved. A gas-liquid separator 145 for separating gaseous refrigerant from evaporated refrigerant is provided on the exit side of the secondary heat exchanger 170.

Refrigerant passing through the secondary heat exchanger 170 is gas-liquid separated at the gas-liquid separator 145, and separated gaseous refrigerant may branch into the first and second compressors 110 and 112 and may be suctioned into the first and second compressors 110 and 112.

The heat-pump system 10 further includes a cooling-water flow path 165 that guides the flow of cooling water. In addition, a cooling-water pump 160 generating the flow of cooling water may be installed on the cooling-water flow path 165.

When the cooling-water pump 160 operates, cooling water may flow in the cooling-water flow path 165 and pass through the secondary heat exchanger 170. As described, cooling water may perform heat exchanger with refrigerant in the secondary heat exchanger 170 and thus be cooled.

The heat-pump system 10 may include an engine 120 that generates power for operating the first compressor 110. The first compressor 110 may be a gas engine compressor that operates by the driving power of the engine 120. On the contrary, the second compressor 112 may be an electromotive compressor that operates by an electric motor.

The cooling-water flow path 165 passes through the engine 120. Cooling water may cool the engine 120 while passing through the engine 120. That is, while flowing in the cooling-water flow path 165, cooling water may cool the engine 120 and heat refrigerant in the secondary heat exchanger 170.

Figure 2:
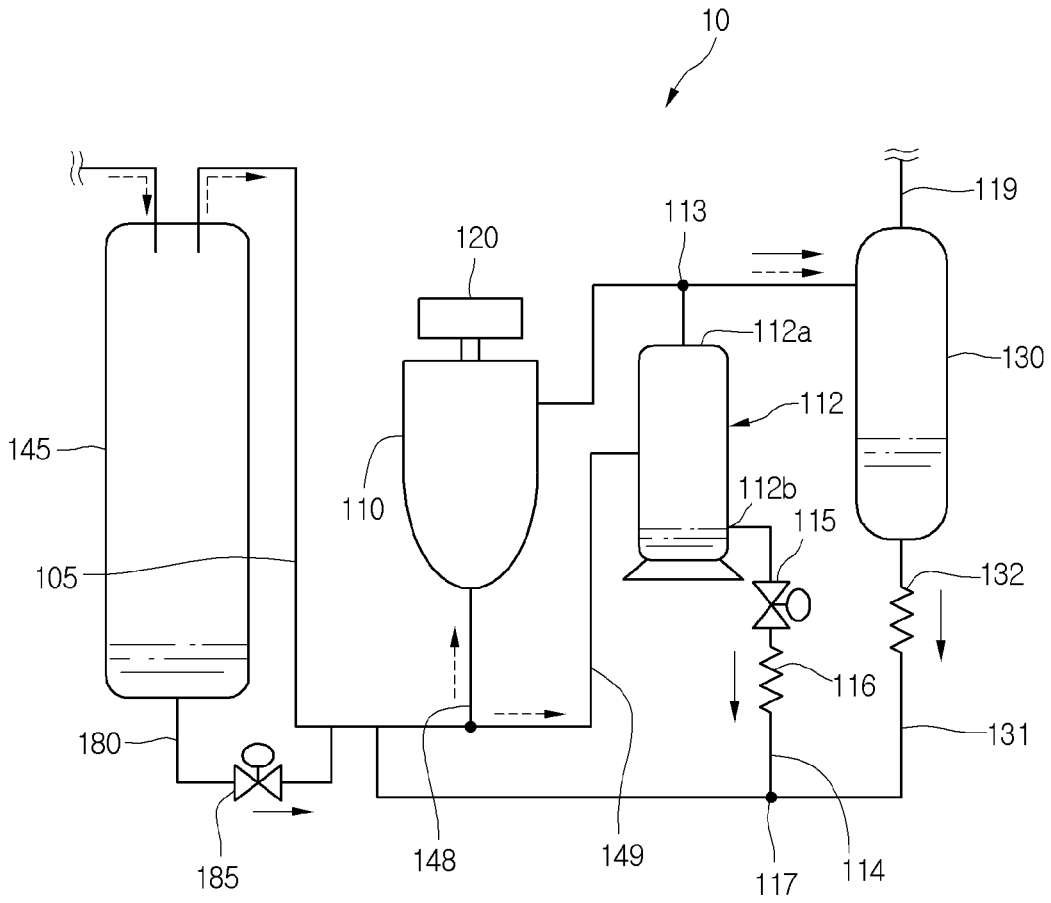
FIG. 2 shows an oil recovery structure of a heat-pump system according to a first embodiment of the present invention.

FIG. 2 shows an oil recovery structure of a heat-pump system according to a first embodiment of the present invention.

Referring to FIG. 2, the heat-pump system 10 according to the first embodiment of the present invention includes the gas/liquid separator 145 into which evaporated refrigerant flows, the first and second compressors 110 and 112 into which gaseous refrigerant separated by the gas/liquid separator 145 flows, and an oil separator 130 that is provided on the discharge sides of the first and second compressors 110 and 112 and separates oil mixed with compressed refrigerant.

An oil separator discharge pipe 119 through which refrigerant having no oil due to the separation of oil by the oil separator 130 is discharged is extended to one side of the oil separator 130.

The first compressor 110 is a gas engine compressor and may be coupled to the engine 120. In addition, the second compressor 112 is an electromotive compressor and may be connected in parallel to the first compressor 110.

The second compressor 112 is a compressor useful for dealing with low load and has an advantage in that operation efficiency is high. In addition, the first compressor 110 may be understood as a large-capacity compressor that may be used when load is equal to or greater than a set load.

A common suction pipe 105 is extended to the discharge side of the gas/liquid separator 145. The common suction pipe 105 may branch into a first branch pipe 148 and a second branch pipe 149. The first branch pipe 148 may be connected to the suction side of the first compressor 110 and the second branch pipe 149 may be connected to the suction side of the second compressor 112.

Gaseous refrigerant discharged from the gas/liquid separator 145 may flow in the common suction pipe 105, branch into the first and second branch pipes 148 and 149, and be suctioned by the first and second compressors 110 and 112. The common suction pipe 105 and the first and second branch pipes 148 and 149 may be understood as "suction flow paths" for enabling the first and second compressors 110 and 112 to suction refrigerant.

Refrigerant compressed by the first compressor 110 and the second compressor 112 may join at a first join portion 113 and flow into the oil separator 130. The first join portion 113 is understood as a point at which the discharge-side pipe of the first compressor 110 and the discharge-side pipe of the second compressor 112 join.

Refrigerant flowing into the oil separator 130 may include oil that exists in the first and second compressors 110 and 112. Oil mixed with the refrigerant may be separated inside the oil separator 130 and recovered by the first and second compressors 110 and 112.

In addition, refrigerant separated from the oil flows to the flow switch valve 140 (see FIG. 1) through the oil-separator discharge pipe 119. In FIG. 2, a refrigerant flow is indicated by dotted arrows and an oil flow is indicated by solid arrows.

An oil separation pipe 131 is coupled to the oil separator 130, through which oil separated by the oil separator 130 is discharged. As an example, the oil-separator discharge pipe 119 is coupled to the upper part of the oil separator 130 and the oil separation pipe 131 is coupled to the lower part of the oil separator 130.

A first flow regulating unit 132 for regulating the flow of oil flowing in the oil separation pipe 131 is installed at the oil separation pipe 131. As an example, the first flow regulating unit 132 may include a capillary tube.

The oil separation pipe 131 may be coupled to the common suction pipe 105. Thus, the oil in the oil separation pipe 131 flows into the common suction pipe 105 and may be suctioned by the first and second compressors 110 and 112 via the first and second branch pipes 148 and 149, respectively.

A compressor's balance pipe 114 for discharging oil stored in the second compressor 112 is coupled to the second compressor 112.

More particularly, the second compressor 112 includes a casing 112*a* and an oil balance hole 112*b* that is formed in the casing 112*a*. The oil balance hole 112*b* may be formed at a set height from the lower end of the casing 112*b*. The set height may be a height corresponding to the optimal height of oil.

The compressor side oil balance pipe 114 is coupled to the oil balance hole 112*b* and extended to the oil separation pipe 131. That is, one end of the compressor side oil balance pipe 114 may be coupled to the oil balance hole 112*b* and the other end may be coupled to the oil separation pipe 131.

A first valve 115 and a second flow regulating unit 116 for regulating the flow of oil flowing in the compressor side oil balance pipe 114 may be installed at the compressor side oil balance pipe 114. The second flow regulating unit 116 may be installed on one side of the first valve 115. As an example, the first valve 115 includes a solenoid valve enabling an on/off operation, and the second flow regulating unit 116 may include a capillary tube. As another example, the first valve 115 may include an EVV that may regulate an open/close operation.

The compressor side oil balance pipe 114 is coupled to a second join portion 117 of the oil separation pipe 131.

The second join portion 117 is a portion of the oil separation pipe 131 and is understood as a point at which the compressor side oil balance pipe 114 is connected.

While oil stored in the second compressor 112 has a height equal to or higher than the oil balance hole 112*b*, the oil in the second compressor 112 is discharged to the compressor side oil balance pipe 114. In addition, the flow of the oil in the compressor side oil balance pipe 114 is regulated in the process of passing through the second flow regulating unit 116, and the oil in the compressor side oil balance pipe 114 and the oil in the oil separation pipe 131 join.

In addition, oil after joining flows into the common suction pipe 105 and is mixed with refrigerant discharged from the gas/liquid separator 145. In addition, mixed refrigerant and oil branch into the first and second branch pipes 148 and 149 to be suctioned by the first compressor 110 and the second compressor 112.

The gas/liquid separator 145 is coupled to a gas/liquid separation oil balance pipe 180 that guides oil stored in the gas/liquid separator 145 to the common suction pipe 105. As an example, the gas/liquid oil balance pipe 180 may be coupled to the lower part of the gas/liquid separator 145. On the contrary, a pipe from which gaseous refrigerant separated by the gas/liquid separator 145 may be coupled to the upper part of the gas/liquid separator 145.

A second valve 185 for regulating the flow of oil is installed at the gas/liquid separation oil balance pipe 180. As an example, the second valve 185 includes a solenoid valve enabling an on/off operation. As another example, the second valve 185 may include an EVV that may regulate an open/close operation.

The gas/liquid separation oil balance pipe 180 is coupled to the common suction pipe 105. Thus, when the second valve 185 is open, oil stored in the lower part of the gas/liquid separator 145 may be discharged to the gas/liquid separation oil balance pipe 180 and flow into the common suction pipe 105.

When the first compressor 110 is a gas engine compressor and the second compressor 112 is an electromotive compressor, a small space (reservoir) that may store oil is formed inside the first compressor 110 and a relatively large space that may store oil is formed inside the second compressor 112.

In this case, when the first and second compressors 110 and 112 simultaneously operate, there may be a tendency for relatively more oil to be stored in the second compressor 112. As an example, the height of the oil in the second compressor 112 may be equal to or higher than the oil balance hole 112*b*. That is, there may be a limitation in that oil is excessively stored in the second compressor 112 and the first compressor 110 lacks oil.

Thus, the present embodiment provides the second compressor 112 with the oil balance hole 112*b* and extends the compressor side oil balance pipe 114 from the oil balance hole 112*b* to the oil separation pipe 131 so that oil stored in the second compressor 112 may be divided into the first and second compressors 110 and 112 and then restored.

In conclusion, the height of the oil of the second compressor 112 may decrease to a height corresponding to the oil balance hole 112*b* and a lack of oil in the first compressor 110 may also be solved. In the following, a control method of the heat-pump system according to the present invention is described with reference to the drawings.

Figure 3:
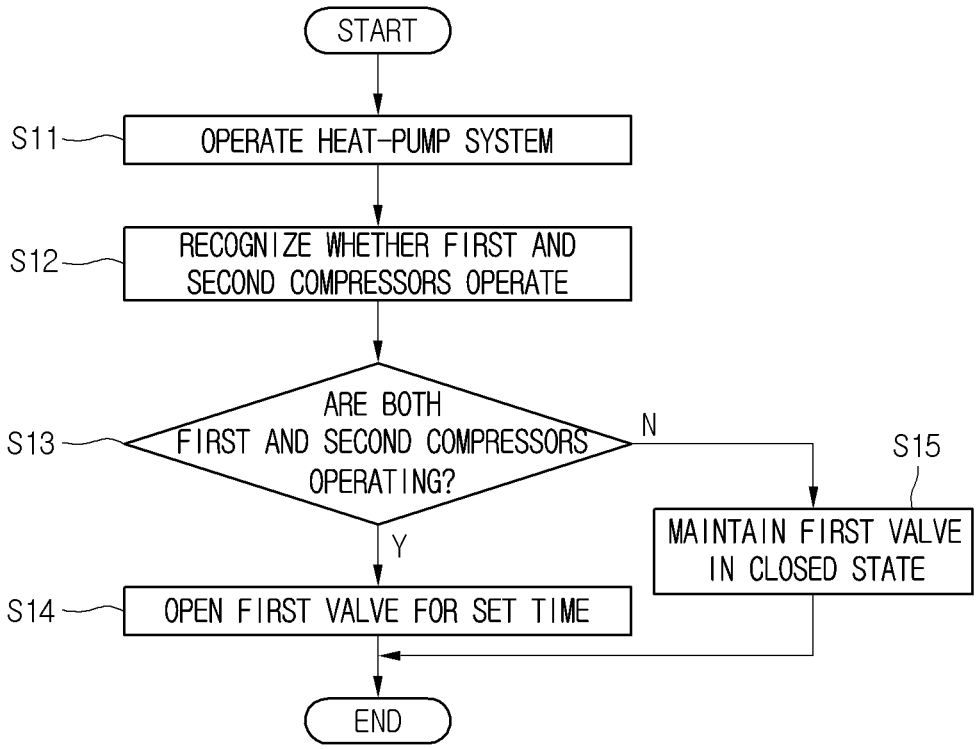
FIG. 3 is a flowchart of a control method of a heat-pump system according to a first embodiment of the present invention.

FIG. 3 is a flowchart of the control method of a heat-pump system according to a first embodiment of the present invention.

Referring to FIG. 3, when the heat-pump system 10 according to the first embodiment of the present invention operates, it is possible to recognize whether the first compressor 110 or the second compressor 112 operates. As described above, the first compressor 110 and the second compressor 112 may be selectively operated depending on an operation load.

As an example, when a desired operation load is equal to or less than a set load, only the second compressor 112 may operate, and when the desired operation load is equal to or more than the set load, both the first and second compressors 110 and 112 may operate.

When only the second compressor 112 operates, gaseous refrigerant discharged from the gas/liquid separator 145 flows into the second compressor 112 via the second branch pipe 149. In addition, oil may flow into the common suction pipe 105 via the oil separation pipe 131 and the compressor side oil balance pipe 114 and may be recovered by the second compressor 112 via the second branch pipe 149.

On the contrary, when both the first and second compressors 110 and 112 operate, gaseous refrigerant discharged from the gas/liquid separator 145 branches and flows into the first and second compressors 110 and 112 via the first and second branch pipes 148 and 149. In addition, oil may flow into the common suction pipe 105 via the oil separation pipe 131 and the compressor side oil balance pipe 114 and may branch into the first and second compressors 110 and 112 via the first and second branch pipes 148 and 149 and then recovered, as shown in steps S11 and S12.

More particularly, when both the first and second compressors 110 and 112 operate, the first valve 115 may be open for a set time. When the first valve 115 is open, oil may flow into the common suction pipe 105 via the compressor side oil balance pipe 114 and the oil separation pipe 131 and may be divided into the first and second compressors 110 and 112 via the first and second branch pipes 148 and 149 and then recovered.

In this case, since the second valve 185 is also open, oil stored in the gas/liquid separator 145 may be recovered by the common suction pipe 105.

When the set time elapses, the first valve 115 is turned off (closed) and thus an oil flow through the compressor side oil balance pipe 114 is restricted. The set time may be determined to a time sufficient to lower the height of oil stored in the second compressor 112 to be equal to or lower than the oil balance hole 112*b* in steps S13 and S14.

On the contrary, when all of the first and second compressors 110 and 112 do not operate, for example, when only the second compressor 112 operates, the first valve 115 maintains a closed state and thus recovery of oil stored in the second compressor 112 by the second compressor 112 is restricted in step S15.

Figure 4:
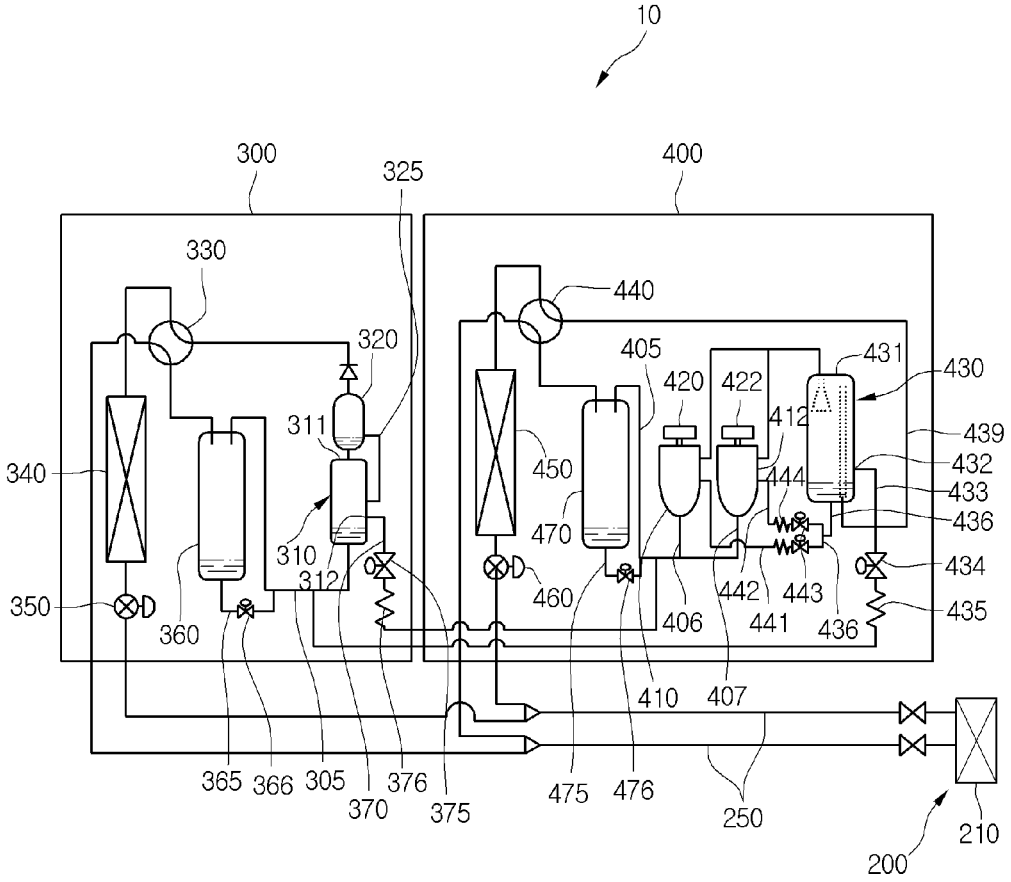
FIG. 4 shows an oil recovery structure of a heat-pump system according to a second embodiment of the present invention.

FIG. 4 shows an oil recovery structure of a heat-pump system according to a second embodiment of the present invention.

Referring to FIG. 4, the heat-pump system 10 according to the second embodiment of the present invention includes a plurality of outdoor units 300 and 400.

The plurality of outdoor units 300 and 400 include the first outdoor unit 300 that generates an electronic heat pump cycle by the operation of an electromotive compressor and the second outdoor unit 400 that generates a gas heat pump cycle by the operation of gas engine compressors 410 and 412.

The first outdoor unit 300 includes the electromotive compressor 310, a first oil separator 320, a flow switch valve 330, a first outdoor heat exchanger 340, a first outdoor expansion device 350 and a first gas-liquid separator 360. Reference is made to the first embodiment for a complete understanding of the functions of these components.

The first outdoor unit 300 includes a first common suction pipe 305 that is extended from the exit side of the first gas-liquid separator 360 to the electromotive compressor 310 and guides the section of gaseous refrigerant to the electromotive compressor 310.

The first outdoor unit 300 includes a first gas-liquid separation oil balance pipe 365 that is extended from the lower part of the first gas-liquid separator 360 to the first common suction pipe 305 and enables oil stored in the first gas-liquid separator 360 to be recovered by the electromotive compressor 310.

In addition, a valve device 366 enabling an on/off operation in order to regulate the flow of oil may be installed at the first gas-liquid separation oil balance pipe 365. The valve device 366 may include a solenoid valve or an electronic expansion valve.

The first outdoor unit 300 includes a first oil separation pipe 325 that is extended from the first oil separator 320 to the electromotive compressor 310. Oil stored in the first oil separator 320 may be recovered by the electromotive compressor 310 through the first oil separation pipe 325. In addition, a valve device (not shown) for regulating the flow of oil may be installed at the first oil separation pipe 325.

The first outdoor unit 300 includes a compressor side oil balance pipe 370 that is extended from the electromotive compressor 310 to the second outdoor unit 400.

More particularly, the electromotive compressor 310 includes a first oil balance hole 312 formed in a casing 311 and one end of the compressor side oil balance pipe 370 is coupled to the first oil balance hole 312. In addition, the other end of the compressor side oil balance pipe 370 may be connected to a second common suction pipe 405 of the second outdoor unit 400.

Thus, oil having a height equal to or higher than the first oil balance hole 312 among oil stored in the electromotive compressor 310 may be recovered by the second outdoor unit 300 through the compressor side oil balance pipe 370.

In addition, a first outdoor unit side valve 375 and a first outdoor flow regulating unit 376 for regulating the flow of oil may be installed at the compressor side oil balance pipe 370. As an example, the first outdoor unit side valve 375 may include a solenoid valve enabling an on/off operation and the first outdoor flow regulating unit 376 may include a capillary tube.

The second outdoor unit 400 includes a plurality of gas engine compressors 410 and 412, a second oil separator 430, a flow switch valve 440, a second outdoor heat exchanger 450, a second outdoor expansion device 460, and a second gas-liquid separator 470. Reference is made to the first embodiment for a complete understanding of the functions of these components.

The plurality of gas engine compressors 410 and 412 may be coupled to gas engines 420 and 422, respectively, and receive driving power therefrom.

The second outdoor unit 400 includes a second common suction pipe 405 that is extended from the exit side of the second gas-liquid separator 470, and first and second branch pipes 406 and 407 that branch from the second common suction pipe 405 and are extended to the plurality of gas engine compressors 410 and 412.

The first branch pipe 406 may be connected to the suction side of the first gas engine compressor 410 of the plurality of gas engine compressors 410 and 412 and the second branch pipe 407 may be connected to the suction side of the gas engine compressor 412.

The second outdoor unit 400 includes a second gas-liquid separation oil balance pipe 475 that is extended from the lower part of the second gas-liquid separator 470 and to the second common suction pipe 405 and enables oil stored in the second gas-liquid separator 470 to be recovered by the first and second gas engine compressors 410 and 412.

In addition, a valve device 476 enabling an on/off operation may be installed at the second gas-liquid separation oil balance pipe 475 in order to regulate the flow of oil. The valve device 476 may include a solenoid valve or an electronic expansion valve. The valve device 366 may be called a "first gas-liquid separation valve" and the valve device 476 may be called a "second gas-liquid separation valve".

The second outdoor unit 400 includes an oil separation oil balance pipe 433 that is extended from the second oil separator 430 to the first outdoor unit 300. The oil separation oil balance pipe 433 is connected to the first common suction pipe 305 of the first outdoor unit 300.

More particularly, the second oil separator includes oil separation casing 431 and a second oil balance hole 432 that is formed at a set height from the lower end of the oil separation casing 431.

One end of the oil separation oil balance pipe 433 is coupled to the second oil balance hole 432, and the other end of the oil separation oil balance pipe is coupled to the first common suction pipe 305. Thus, oil having a height equal to or higher than the oil balance hole 432 may be recovered by the first outdoor unit 300 through the oil separation oil balance pipe 433.

In addition, a second outdoor unit side valve 434 and a second outdoor flow regulating unit 435 for regulating the flow of oil may be installed at the oil separation oil balance pipe 433. As an example, the second outdoor unit side valve 434 includes a solenoid valve enabling an on/off operation and the second outdoor flow regulating unit 435 may include a capillary tube.

The second outdoor unit 400 includes an oil separation discharge pipe 439 that is extended from the second oil separator 430 and discharges refrigerant from which oil has been separated. The oil separation discharge pipe 439 is connected to the flow switch valve 440.

The second outdoor unit 400 includes a second oil separation pipe 436 that is extended from the lower part of the second oil separator 430 and guides the discharge of oil, and first and second oil branch pipes 441 and 442 that are branched from the second oil separation pipe 436.

The second oil separation pipe 436 may be coupled to the second oil separator 430 at a location lower than the second oil balance hole 432.

The first oil branch pipe 441 is coupled to the first gas engine compressor 410 and guides the recovery of oil, and the second oil branch pipe 442 is coupled to the second gas engine compressor 412 and guides the recovery of oil.

In addition, an oil branch valve 443 and an oil branch flow regulating unit 444 for regulating the flow of oil may be installed at the first and second oil branch pipes 441 and 442. As an example, the oil branch valve 443 may include a solenoid valve enabling an on/off operation and the oil branch flow regulating unit 444 may include a capillary tube.

The flow of oil under such a configuration is simply described.

When the first outdoor unit 300 or the electromotive compressor operates and the first outdoor unit side valve 375 opens, the flow of oil stored in the electromotive compressor 310 is regulated at the first outdoor flow regulating unit 376 and the oil flows into the second common suction pipe 405 of the second outdoor unit 400.

In addition, the oil flowing into the second common suction pipe 405 may be recovered by the first and second gas engine compressors 410 and 412 via the first and second branch pipes 406 and 407.

The first gas-liquid separation valve 366 also opens, so oil stored in the first gas-liquid separator 360 may be recovered by the electromotive compressor 310.

When the second outdoor unit 400 or the first and second gas engine compressors 410 and 412 operate and the second outdoor unit side valve 434 opens, the flow of oil stored in the second oil separator 430 is regulated at the second outdoor flow regulating unit 435 and the oil flows into the first common suction pipe 305 of the first outdoor unit 300.

In addition, oil flowing into the first common suction pipe 305 may be recovered by the electromotive compressor 310.

The second gas-liquid separation valve 476 and the oil branch valve 443 also open, so oil stored in the second gas-liquid separator 470 and the second oil separator 430 may be recovered by the first and second gas engine compressors 410 and 412.

According to such a configuration, when there is oil imbalance between the first and second outdoor units 300 and 400, there is an effect in that oil may be recovered by the outdoor unit that lacks oil.

Figure 5:
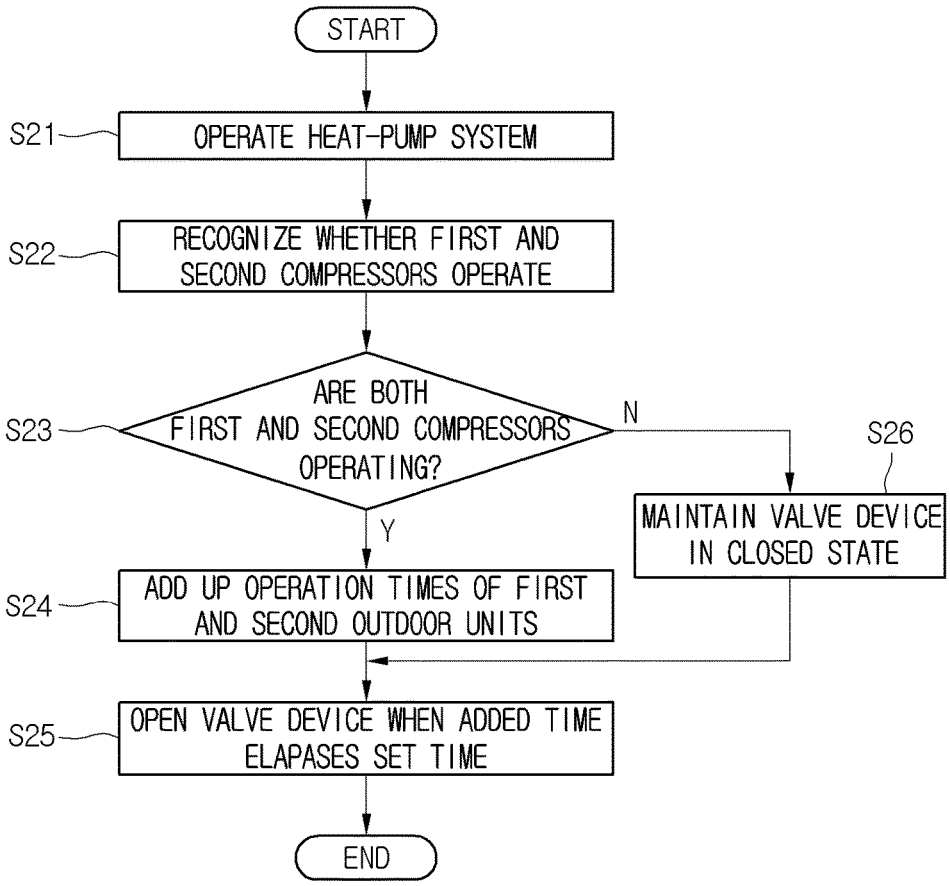
FIG. 5 is a flowchart of a control method of a heat-pump system according to a second embodiment of the present invention.

FIG. 5 is a flowchart of a control method of the heat-pump system according to the second embodiment.

Referring to FIG. 5, when the heat-pump system 10 according to the second embodiment operates, whether the first outdoor unit 300 or the second outdoor unit 400 operates may be recognized. The first outdoor unit 300 or the second outdoor unit 400 may selectively operate depending on an operation load.

As an example, when a desired operation load is equal to or less than a set load, only the first outdoor unit operates; when the desired operation load is equal to or more than the set load, both the first and second outdoor units 300 and 400 may operate in steps S21 and S22.

More particularly, when both the first and second outdoor units 300 and 400 operate, the operation times of the first and second outdoor units 300 and 400 may be added up.

When an added time passes a set time, the first outdoor unit side valve 375 and the second outdoor unit valve 434 may open.

As the first outdoor unit valve 375 opens, oil having a height equal to or higher than the first oil balance hole 312 among the oil stored in the electromotive compressor 310 flows into the second common suction pipe 405 of the second outdoor unit 400 via the compressor side oil balance pipe 370.

In addition, oil branches into the first and second gas engine compressors 410 and 412 and is suctioned by them.

In addition, as the second outdoor unit valve 434 opens, oil having a height equal to higher than the second oil balance hole 432 among oil stored in the second oil separator 430 flows into the first common suction pipe 305 of the first outdoor unit 300 via the oil separation oil balance pipe 433. In addition, oil is suctioned by the electromotive compressor 310.

In this case, the first and second gas-liquid separation valves 366 and 476 open and oil stored in the first and second gas-liquid separators 360 and 470 may be recovered by the compressor of each outdoor unit.

In addition, the oil branch valve 443 opens, and oil stored in the second oil separator 430 may branch into the first and second gas engine compressors 410 and 412 and be recovered by them in step S23.

Accordingly, oil present inside each outdoor unit may be easily recovered by a compressor and there is an advantage in that oil may be recovered by an outdoor unit lacking oil when there is oil imbalance between the first and second outdoor units 300 and 400.

In step S23, when both the first outdoor unit 300 and the second outdoor unit 400 do not operate, the first outdoor unit valve 375 and the second outdoor unit valve 434 may maintain a closed state.

According to the heat-pump system of the embodiment, there is an advantage in that it is possible to easily recover oil when the compressor operates, because oil separated from the oil separator or the compressor is supplied to the common suction pipe of the compressor.

In particular, when the outdoor unit includes both the electromotive compressor and the gas engine compressor, there is an advantage in that it is possible to prevent oil from becoming excessively stored in the electromotive compressor and the gas engine compressor from experiencing a lack of oil depending on the operation state of the compressor.

Also, since the electromotive compressor includes the oil balance hole and the compressor side oil balance pipe is extended from the oil balance hole to the common suction pipe of the oil balance hole, oil having a height equal to or higher than the oil balance hole of the electromotive compressor may be effectively distributed to the gas engine compressor.

Also, since the first outdoor unit including the electromotive compressor is linked to the second outdoor unit including the gas engine compressor in order to distribute oil, there is an advantage in that it is possible to prevent oil imbalance between a plurality of outdoor units.

According to the heat-pump system of the embodiment, it is possible to easily recover oil when the compressor operates, because oil separated from the oil separator or the compressor is supplied to the common suction pipe of the compressor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A heat-pump system comprising:

a first outdoor unit comprising a first compressor, a first outdoor heat exchanger, a first switch value, a first expansion device, a first common suction line of said first compressor and a first oil separator;

a second outdoor unit comprising a second compressor, a second outdoor heat exchanger, a second switch valve, a second expansion device, a second common suction line of said second compressor and a second oil separator;

a compressor side oil balance pipe coupled to the first compressor, said compressor side oil balance pipe extends from the first compressor and is fluidly coupled to the second common suction line of second compressor, the compressor side oil balance pipe allowing oil in the first compressor to be recovered by the second compressor; and an oil separator side oil balance pipe coupled to the second oil separator, said oil separator side oil balance pipe extends from the second oil separator and is fluidly coupled to the first common suction line of the first compressor, wherein the first compressor includes a first oil balance hole formed in a casing, one end of the compressor side oil balance pipe being coupled to the first oil balance hole so as to recover the oil above a height of the first oil balance hole that is stored in the first compressor to the second outdoor unit, and wherein the second oil separator includes a second oil balance hole formed in an oil separation casing, one end of the oil separator side oil balance pipe being coupled to the second oil balance hole so as to recover the oil above the height of the second oil balance hole that is stored in the second oil separator to the first outdoor unit.

2. The heat-pump system according to claim 1, wherein the first outdoor unit includes a first gas-liquid separator provided at an inlet side of the first compressor, wherein the first gas-liquid separator separates gaseous refrigerant from refrigerant and supplies the gaseous refrigerant to the first compressor; and a first gas-liquid separation, oil balance pipe extended from the first gas-liquid separator to the first common suction pipe.

3. The heat-pump system according to claim 1, further comprising a first valve device located in the compressor side oil balance pipe for regulating a flow of oil in the compressor side oil balance pipe.

4. The heat-pump system according to claim 1, wherein the second outdoor unit includes a gas liquid separator provided at an inlet side of the second compressor, wherein the gas-liquid separator separates gaseous refrigerant from refrigerant and supplies the gaseous refrigerant to the second compressor; and a gas liquid separation oil balance pipe extended from the gas liquid separator to the second common suction pipe.

5. The hexa pump system according to claim 1, further comprising a valve device located in the oil separator side oil balance pipe for regulating a flow of oil in the oil separator side oil balance pipe.

6. The heat-pump system according to claim 1, wherein the first outdoor unit includes a first oil separation pipe extending from the first oil separator to the first compressor, and wherein the second outdoor unit includes a second oil separation pipe extending from the second oil separator to the second compressor.

7. The heat-pump system according to claim 6, wherein the first outdoor unit in a first oil separation pipe valve located in the first oil separation pipe for regulating a flow of oil in the first oil separation pipe, and wherein the second outdoor unit includes a second on separation pipe valve located in the second oil separation pipe for regulating a flow of oil in the second oil separation pipe.

8. The heat-pump system according to claim 1, wherein the first compressor is an electromotive compressor, and wherein the second compressor is a gas engine compressor.

9. The heat-pump system according to claim 1, further comprising:

the first common suction of refrigerant to the first compressor, the oil separator side oil balance pipe being coupled to the first common suction pipe;

a first gas-liquid separator provided at an inlet side of the first compressor, the first gas-liquid separator being configured to separate gaseous refrigerant from refrigerant and supply the gaseous refrigerant to the first compressor;

a first gas-liquid separation oil balance pipe extended from the first gas-liquid separator to the first common suction pipe;

the second common suction pipe guiding suction of refrigerant to the second compressor the compressor side oil balance pipe being coupled to the second common suction pipe;

a second gas-liquid separator provided at an inlet side of the second compressor, the second gas-liquid separator being configured to separate gaseous refrigerant from refrigerant and supply the gaseous refrigerant to the second compressor; and a second gas-liquid separation oil balance pipe extended from the second gas-liquid separator to the second common suction pipe.

10. The heat-pump system according to claim 9, further comprising:

a first valve device located in the compressor side oil balance pipe for regulating a flow of oil in the compressor side oil balance pipe;

a second valve device located in the oil separator side oil balance pipe for regulating a flow of oil in the oil separator side oil balance pipe;

a first oil separation pipe extending from the first oil separator to the first compressor;

a first oil separation pipe valve located in the first oil separation pipe for regulating a flow of oil in the first oil separation pipe;

a second oil separation pipe extending from the second oil separator to the second compressor; and a second oil separation pipe valve located in the second oil separation pipe for regulating a flow of oil in the second oil separation pipe.

* * * * *